United States Patent [19]

Okopny

[11] Patent Number: 4,699,067

[45] Date of Patent: Oct. 13, 1987

[54] KNOCK-DOWN DISPLAY TABLE

[76] Inventor: Morris J. Okopny, 6 Silvermaple Court, Apt. 1515, Bramalea, Ontario, L6T 4N5, Canada

[21] Appl. No.: 901,410

[22] Filed: Aug. 28, 1986

[51] Int. Cl.[4] ..... A47B 9/00

[52] U.S. Cl. ..... 108/111; 108/108; 211/189

[58] Field of Search ..... 108/111, 114, 108, 110, 108/106, 107; 211/189, 135, 186, 187, 153; 248/235

[56] References Cited

U.S. PATENT DOCUMENTS

| | | | |
|---|---|---|---|
| 1,109,765 | 9/1914 | Lampert | 211/135 X |
| 1,473,817 | 11/1923 | Gorsline . | |
| 2,256,996 | 9/1941 | Bales . | |
| 3,279,876 | 10/1966 | Cyr | 108/107 X |
| 3,397,858 | 8/1968 | Williams | 211/189 X |
| 3,481,486 | 12/1969 | Squires | 108/106 X |
| 3,965,826 | 6/1976 | Markham | 211/187 X |
| 4,034,683 | 7/1977 | DiCenzo | 108/111 |
| 4,101,233 | 7/1978 | McConnell . | |
| 4,108,085 | 8/1978 | Shepherd et al. | 108/111 X |
| 4,317,523 | 3/1982 | Konstant et al. | 108/107 X |
| 4,351,246 | 9/1982 | Hutchins, Jr. | 108/111 X |
| 4,379,431 | 4/1983 | Clement | 108/111 |
| 4,429,850 | 2/1984 | Weber et al. | 108/108 X |
| 4,491,226 | 1/1985 | Marschak | 108/111 X |
| 4,513,669 | 4/1985 | Steinke | 108/111 |
| 4,515,280 | 5/1985 | Sheu | 211/189 |
| 4,518,279 | 5/1985 | Suttles | 211/189 X |
| 4,606,170 | 8/1986 | Mendenhall | 211/135 X |

*Primary Examiner*—Kenneth J. Dorner
*Assistant Examiner*—José V. Chen
*Attorney, Agent, or Firm*—Ridout & Maybee

[57] ABSTRACT

A display table is provided which is easily assembled and disassembled for re-location and storage. The display table assembly includes a tabletop frame which is provided with an upper inwardly- and downwardly-directed peripheral flange forming a narrow channel, and a lower inwardly-directed flange. The lower flange has at least three L-shaped apertures defined in it. Where the tabletop frame is of rectangular configuration, an L-shaped aperture is formed at each corner. A plurality of legs of angle-section, with each leg being upwardly receivable through one of the L-shaped apertures and snugly receivable in the channel of the upper flange, are also provided. The table surface is formed of several leaves which rest on the lower flange of the tabletop frame. A base frame for urging the legs resiliently outward, may also be provided for improved stability of the assembled structure.

18 Claims, 9 Drawing Figures

KNOCK-DOWN DISPLAY TABLE

BACKGROUND OF THE INVENTION

This invention relates to an assembly for a display table.

For use in retail outlets, it is desirable to have a display table for merchandise which is easy to assemble and disassemble, yet sturdy enough to tolerate the strains and loads imposed by the quantities of merchandise on display and customer jostling.

To allow for change of display and easy storage, it has always been preferable to provide display table kits, which, after assembly, may be disassembled.

. Traditionally, the parts of such display tables are fastened with bolts or screws, and generally require at least two people to assemble.

In order to ensure that the assembled table is sturdy, the bolts or screws must be fastened tightly, but this then makes disassembly much more difficult. It is also difficult to keep control of a number of bolt or screw fasteners, which easily become misplaced, preventing assembly of the table.

SUMMARY OF THE INVENTION

The present invention is directed to an improved construction for a display table which may be easily assembled by one person, and provides a sturdy display table which is also easy to disassemble for relocation and storage, and which does not rely on mechanical fasteners for stability.

In one embodiment, a table assembly is provided consisting of a tabletop frame which is constructed with an upper inwardly- and downwardly-directed peripheral flange forming a narrow channel. The tabletop frame is also constructed with a lower inwardly-directed flange which has at least three L-shaped apertures defined in it. A plurality of legs of angle-section (corresponding to the number of L-shaped apertures) is also provided. Each leg is upwardly receivable through one of the L-shaped apertures and is snugly receivable in the channel of the upper flange.

Preferably, the tabletop frame is of rectangular configuration, with an L-shaped aperture formed at each corner.

Also, two struts of angle-section may be mounted on two adjacent corners of the tabletop frame for mounting an upper shelf between them.

DETAILED DESCRIPTION OF THE PREFERRED EMBODIMENTS

Figure 1:
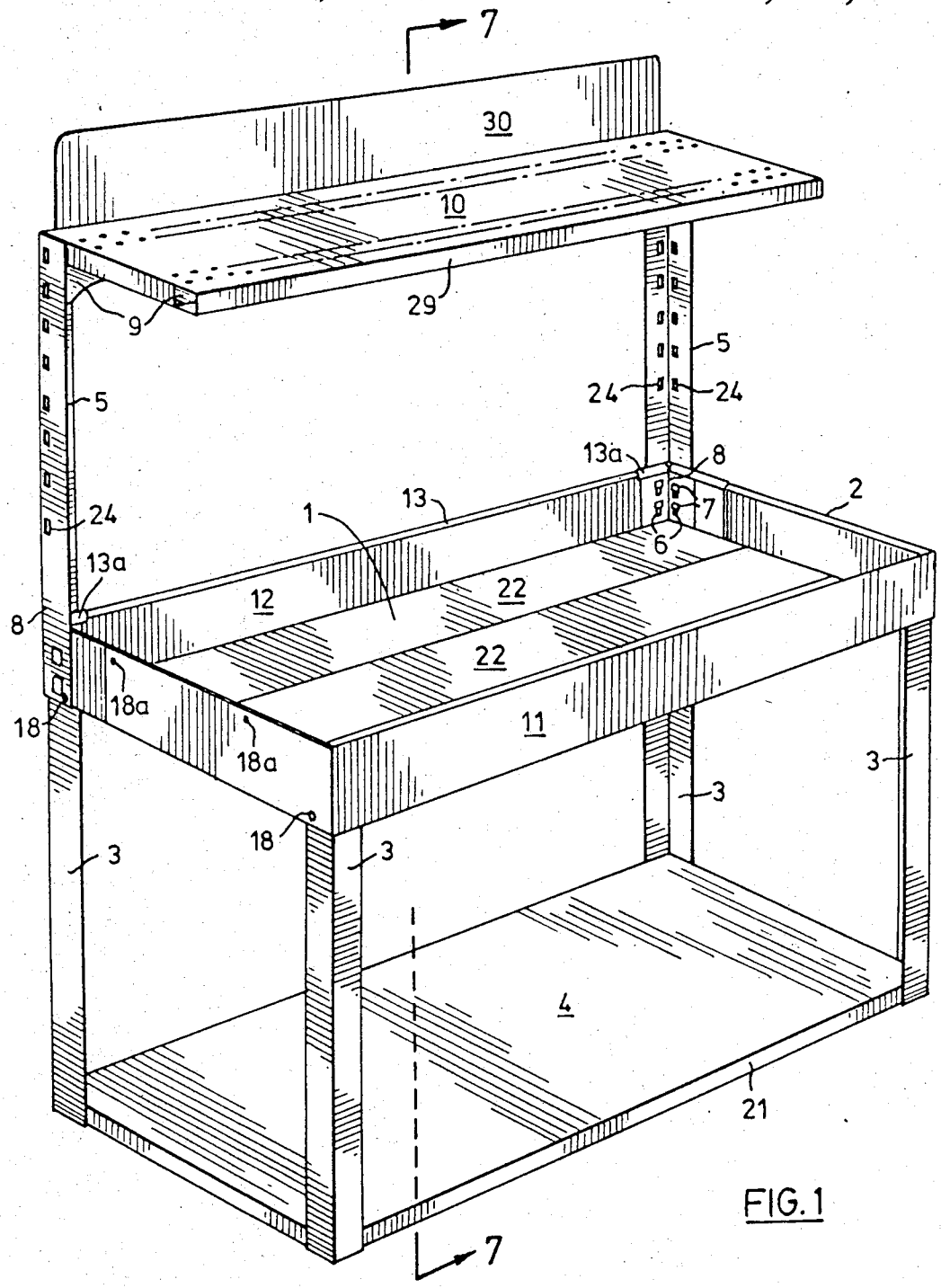
FIG. 1 is a perspective view of the complete display unit.

In FIG. 1 a completely assembled display unit, according to the present invention is illustrated.

The assembled display unit includes a recessed rectangular table surface 1 bounded on all four sides by a tabletop frame 2. The tabletop frame 2 is mounted on four legs 3 of angle-section in the manner described below.

A lower shelf 4 is mounted between the four legs, and acts as a bottom brace to sturdy the entire structure.

Two struts 5 of angle-section are each provided with tongues 6 which are engageable in apertures 7 in adjacent rear corners 8 of the tabletop frame 2 for mounting the struts 5 to extend vertically upward from the tabletop frame 2.

A shelving bracket 9 is mounted on each strut, for supporting upper shelf 10.

FIGS. 2 through 6 illustrate the stages of assembly of a display unit according to the invention.

Figure 2:
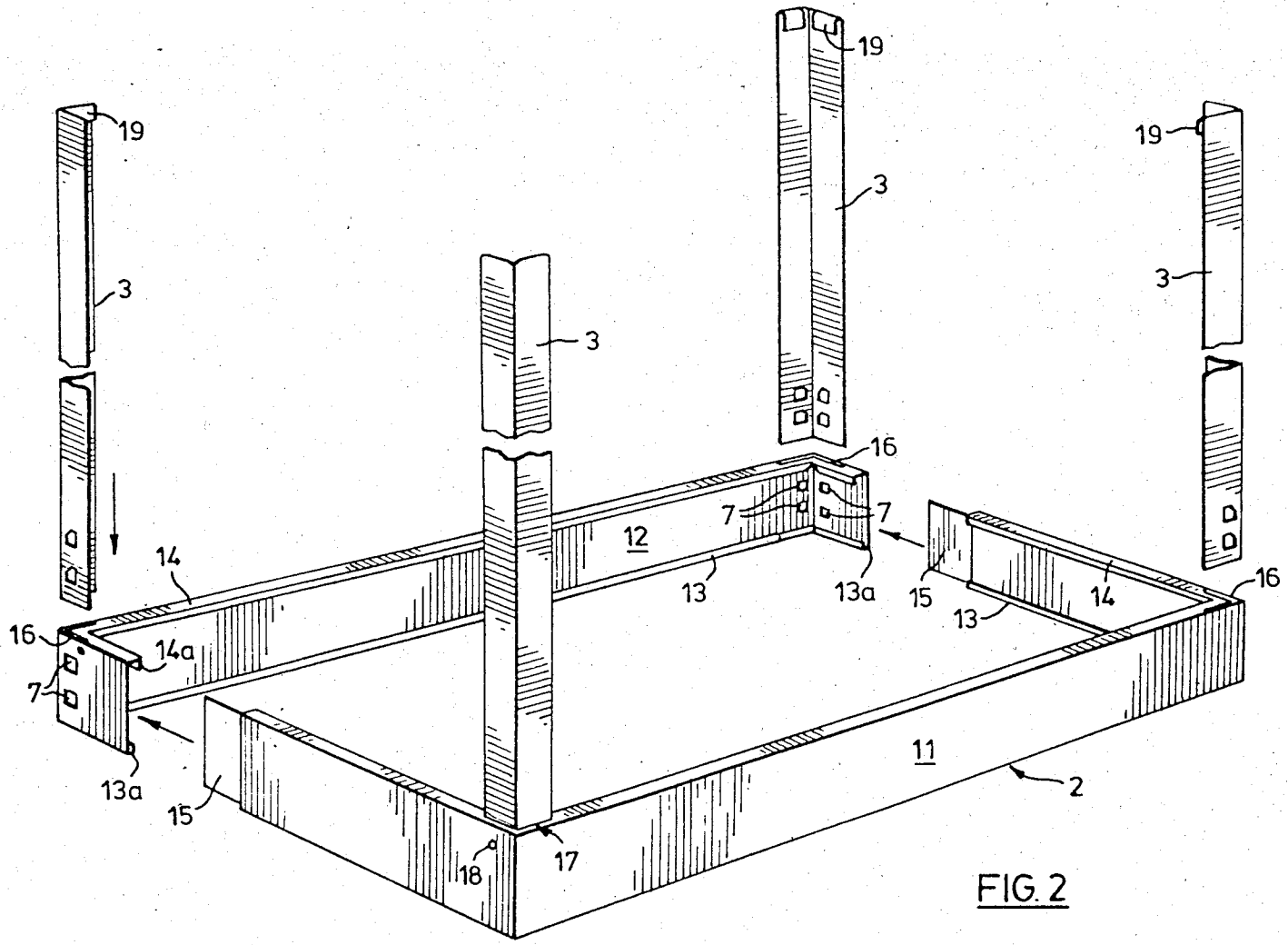
FIGS. 2 through 4 are partial perspective views showing the bottom part of the display unit in sequential stages of assembly.

As shown in FIG. 2, the tabletop frame 2 is a rectangular rail, preferably of stamped and bent metal, formed in two sections, a front section 11 and a rear section 12.

Figure 6:
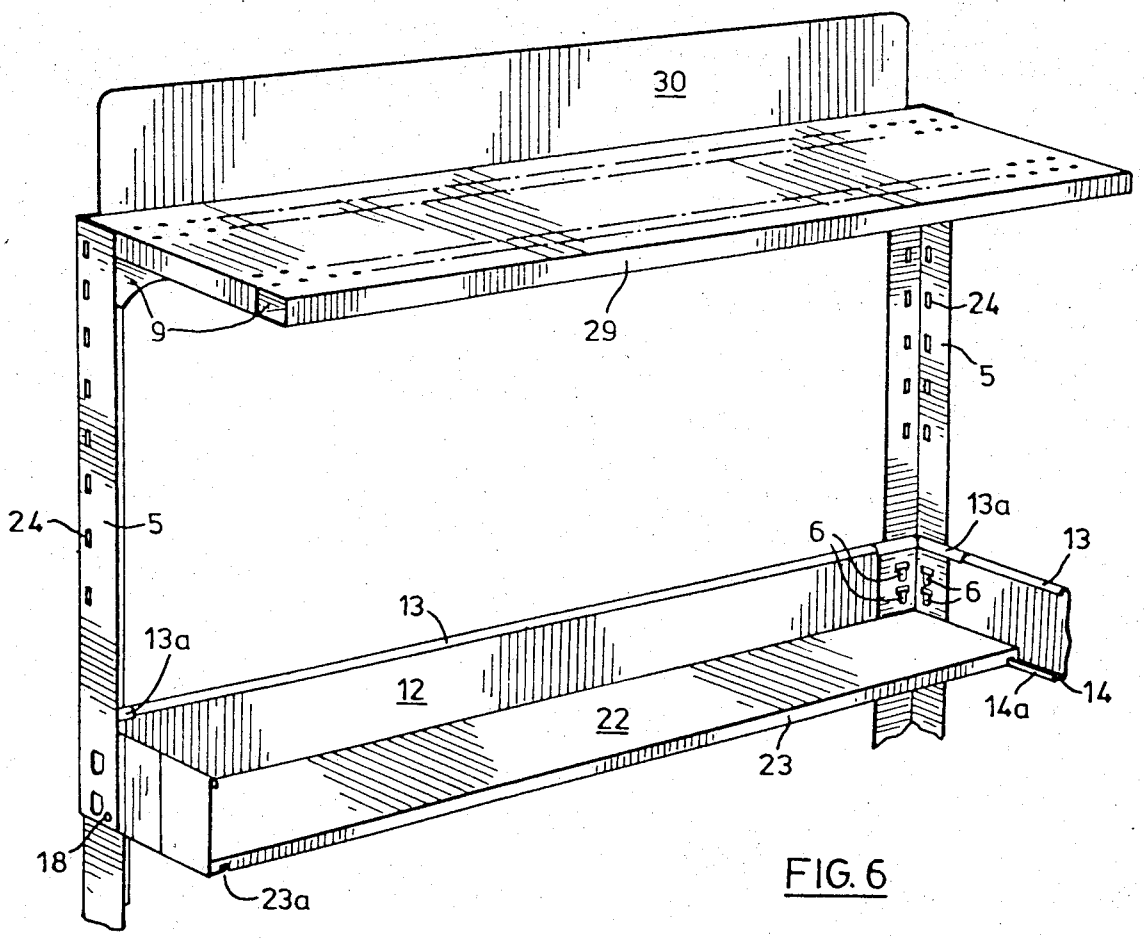

Each section is provided with upper and lower peripheral flanges, 13 and 14 respectively. Lower flange 14 is provided with lip **14*a* to form a channel section (FIG. 6). Upper flange 13 is hemmed or rolled flat against the rail of the tabletop frame throughout most of the periphery except at the corners of the tabletop frame 2 where upper flange 13 is outwardly offset to form corner channels 13*a*. It is preferable if a V-notch is made in both upper and lower flanges 13 and 14** at each corner to facilitate the rolling in.

The hemming of the upper flange 13 against the rail of the tabletop frame 2 performs a reinforcing or stiffening function, as well as eliminating sharp edges which could damage displayed merchandise or be dangerous for customers.

To assemble, the front section 11 and rear section 12 are joined by inserting male ends 15 of the front section 11 into the channels formed by the upper flange 13 at **13*a* and by the lower flange 14, both of the rear section 12. Male ends 15 are offset so that a flush surface is formed on insertion with the rear section 12**.

In order to completely secure the tabletop frame, the joints between the offset portions 15 and the sides 12 may then be spot-welded.

As illustrated in FIG. 2, the tabletop frame 2 is turned upside down to facilitate mounting of legs 3.

The legs 3 may be of any length required to provide a display table of useable height.

Preferably, legs 3 will be formed of bent metal, and therefore, customizing the height of the table to the retailer-customer's needs will be facilitated.

To mount the tabletop frame 2 on legs 3, L-shaped apertures 16 are provided in the lower flange 14 at each corner of the tabletop frame.

Each leg 3 is simply inserted into one of the L-shaped apertures 16 as shown at 17 in FIG. 2, and is snugly received under the corner channel **13*a* of the upper flange 13**.

Figure 3:
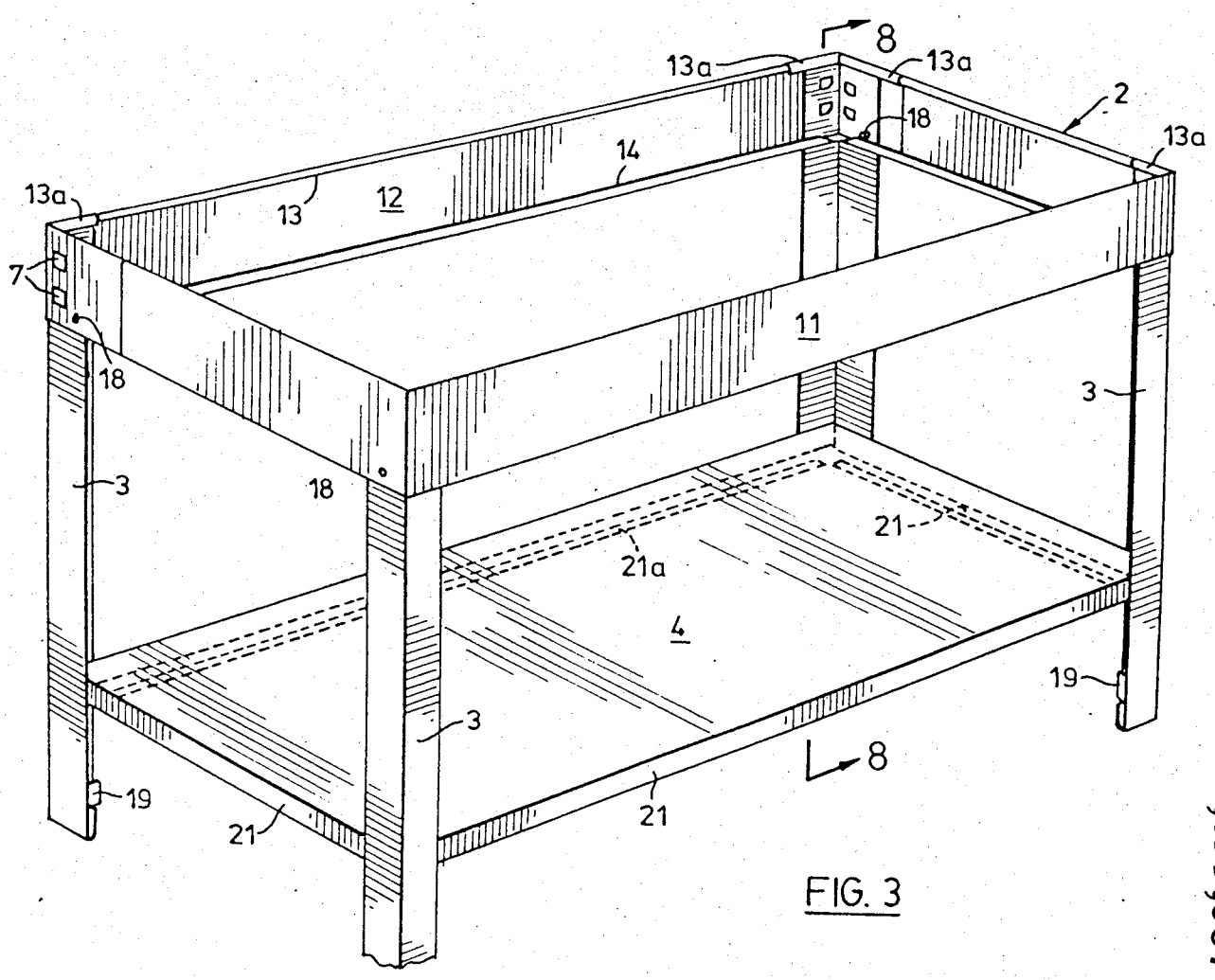
Figure 4:
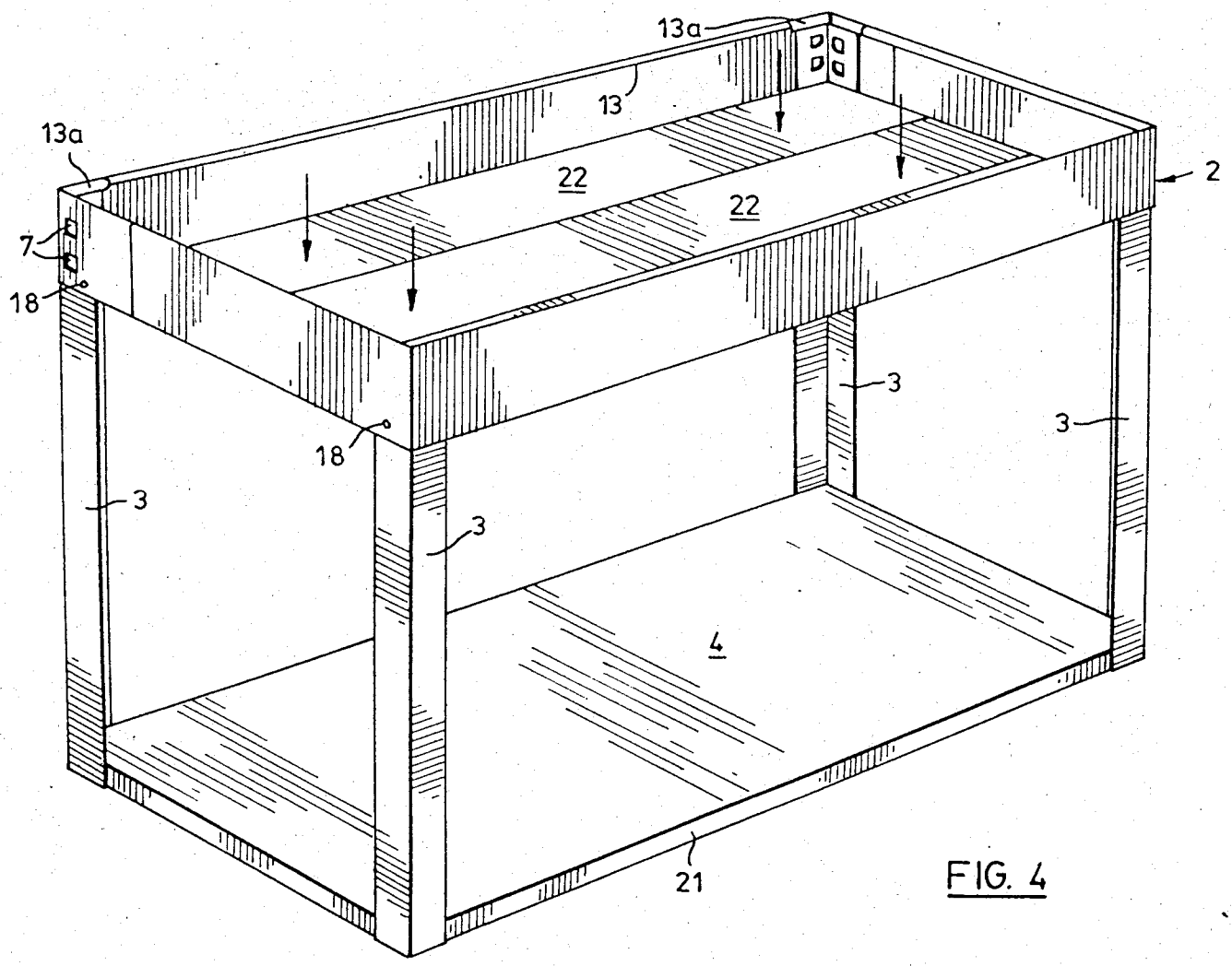
Figure 5:
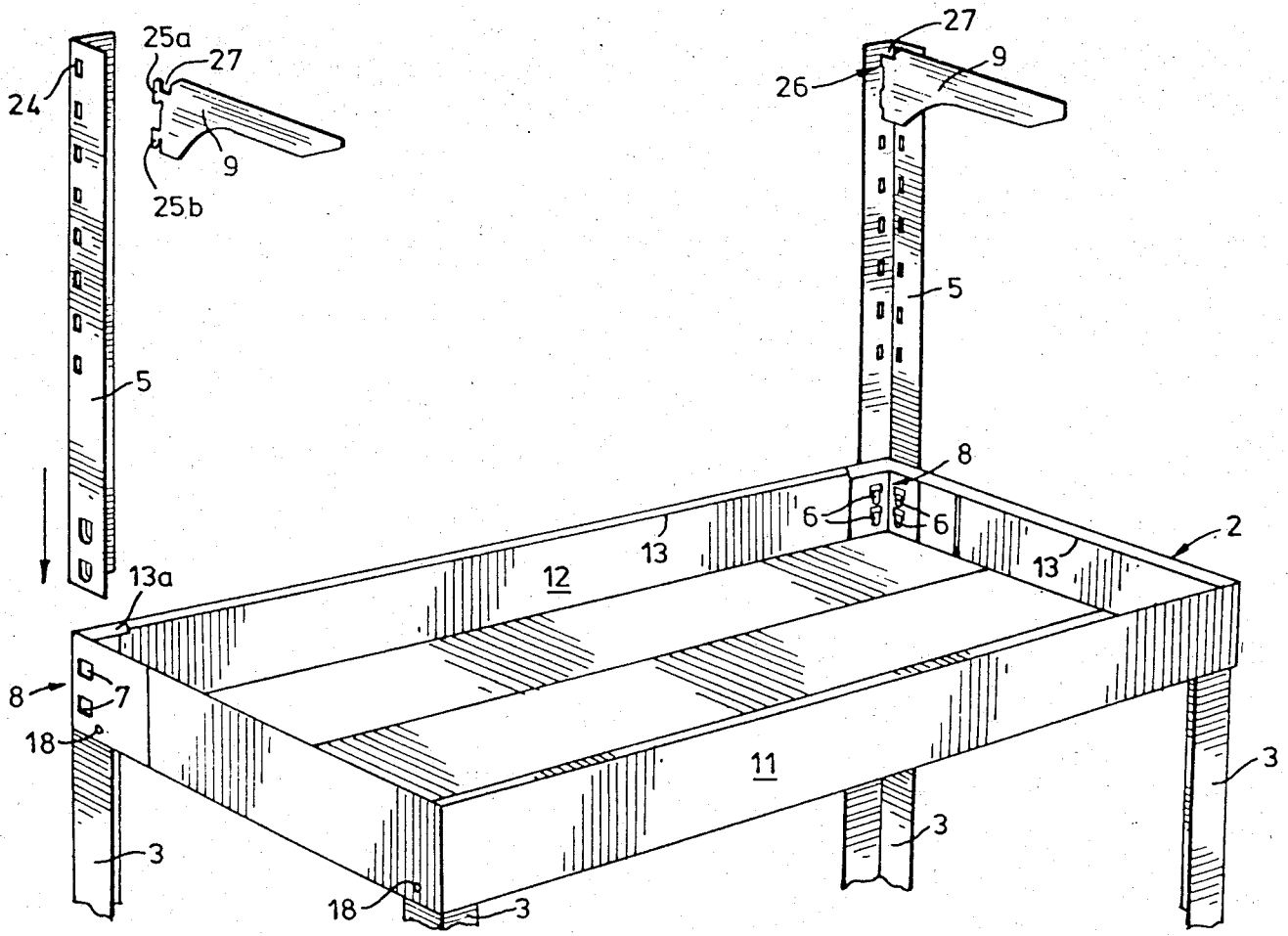
FIGS. 5 and 6 are views similar to FIGS. 2 through 4 showing the top part of the display unit in sequential stages of assembly after that shown in FIG. 4.

The corner channel flange **13*a* acts as an abutment or stop engaging longitudinally and locating laterally the tops of legs 3, so that when the display assembly is turned right side up, as shown in FIGS. 3 through 5, the tabletop frame rests on legs 3 at the upper corner channel 13*a*, and the upper ends of legs 31** held against movement away from corners of the frame, preventing swaying.

The legs 3 may be secured in place to prevent detachment when the display unit is being moved or lifted, through insertion of tapered plugs 18 (fully illustrated in FIG. 9) at the corners, securing tabletop frame 2 to each leg 3, but in the assembled, upright position, the display table does not rely on the plugs 18 for its stability. Only one plug 18 is required to be inserted at each corner.

Figure 9:
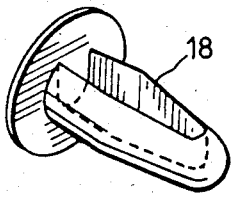
FIG. 9 is a perspective view of a tapered plug fastener used in assembling the display unit.

Other fasteners such as screws and bolts may also be used, but are not needed and are not as easily removable for disassembly as the tapered plugs illustrated in FIG. 9.

The bottom of each leg 3 is folded over or beaded forming a foot flange 19 on each surface of the angle section. This eliminates any sharp edges, resulting from cutting the metal leg, which could damage floor surfaces.

The next stage of assembly, as illustrated in FIG. 3, requires that the display assembly be righted.

Lower shelf 4 is tilted to allow it to be inserted between the four legs 3 and is then rotated to the horizontal position and pushed downwardly as shown in FIG. 3 to provide a bottom brace to the display unit. The lower shelf 4 has outer sides with a peripheral circumference to provide lower bracing for the assembly by the action of the outer sides urging the legs resiliently outwardly, thereby preventing the legs from buckling due to loads placed on the display table assembly.

The legs 3 will be prevented from skewing outwardly by the opposite action of the tabletop rail 2 combined with the upper corner channels 13*a* on the tops of the legs 3.

Figure 7:
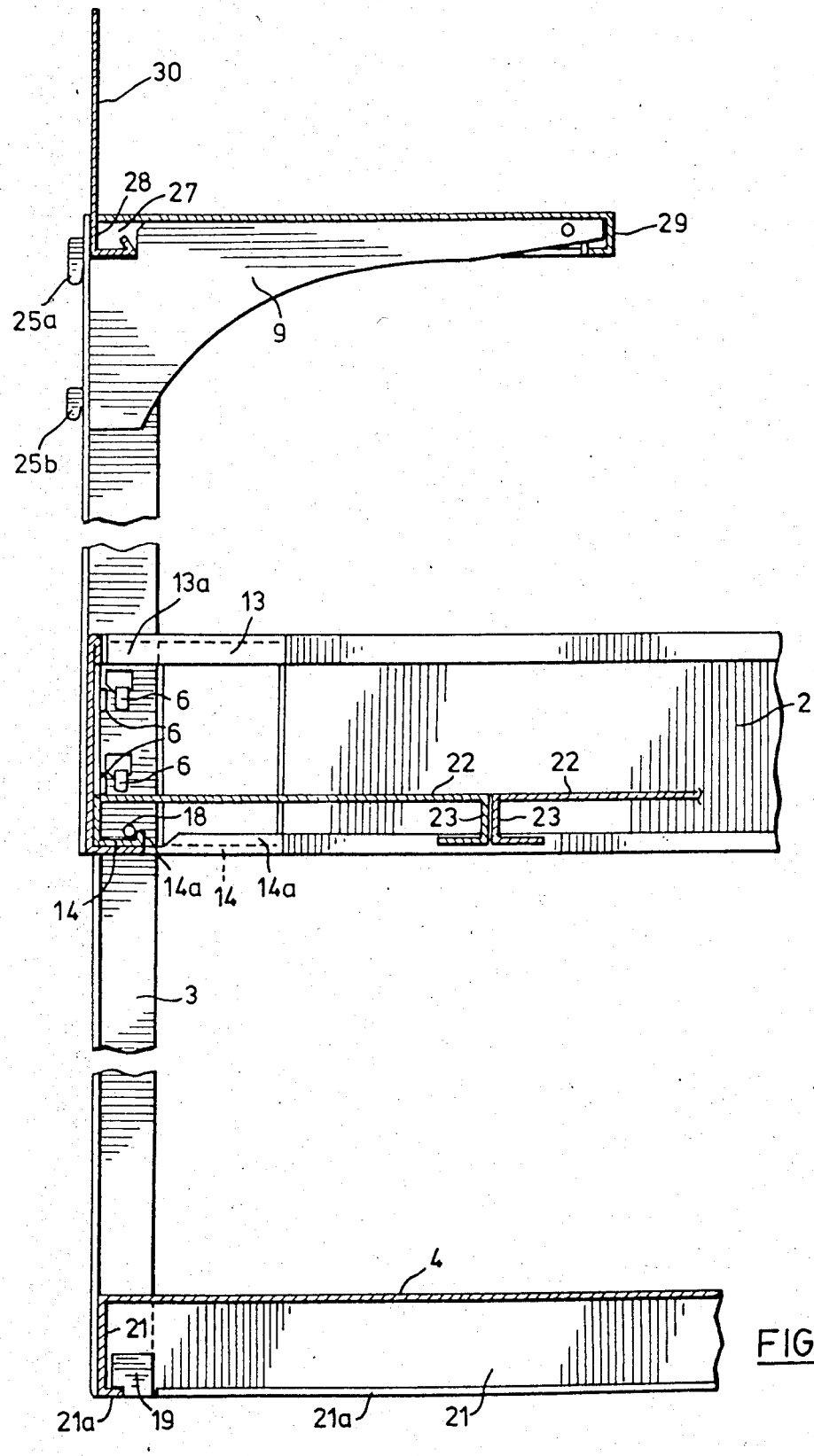
FIG. 7 is a vertical cross-sectional fragmentary view, taken through line 7—7 of FIG. 1, showing the display unit.
Figure 8:
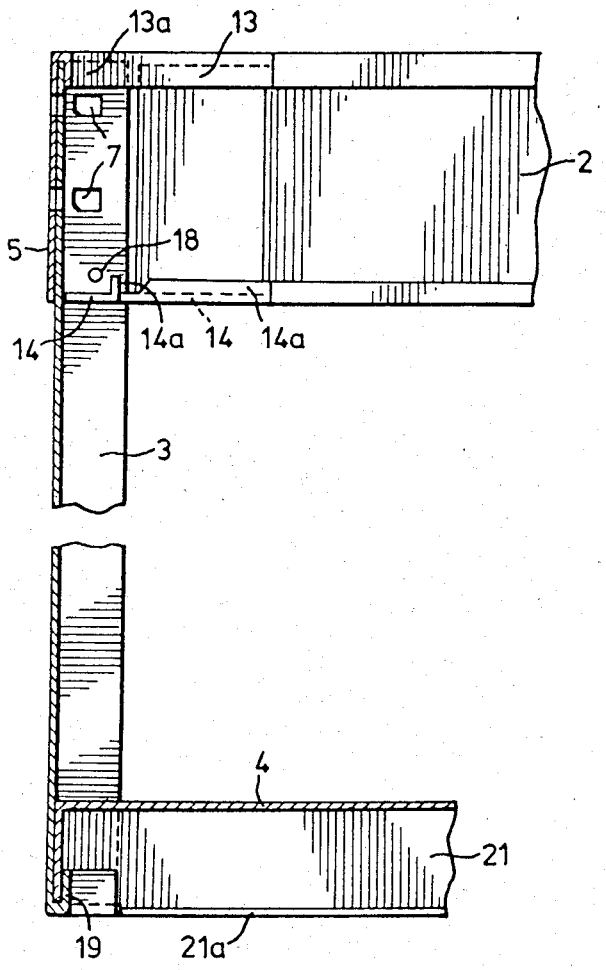
FIG. 8 is a view, similar to FIG. 7, taken through line 8—8 of FIG. 3, showing the bottom portion of the display unit.

The edge of the lower shelf 4 is provided with peripheral flange 21 which is rolled under to form a lip flange 21*a* engaging the foot flange 19 on each angle surface of each leg 3 to provide an abutment for the lower shelf 4 (FIGS. 7 and 8).

FIG. 4 illustrates the assembly of the table surface, composed of three rectangular leaves 22, which rest on the lower hem flange 14 of the tabletop frame in side-to-side abutment.

As shown in FIG. 7, the leaves will preferably be of similar construction to the lower shelf 4, that is provided with a peripheral flange 23. However, as shown in FIG. 6, the peripheral flange 23 is provided with notches 23*a* toward either end of each leaf 22 for accommodating lip 14*a* of lower flange 14 on the tabletop frame 2. In this way, leaves 22 hook onto lip 14*a* of lower flange 14.

Notches 23*a* interacting with lip 14*a* increase the rigidity of the table assembly by providing bracing for the upper portion of the table in one direction.

In order to increase the display capacity of the unit, according to the invention, an upper shelf may be added as illustrated in FIGS. 5 and 6, and as previously described.

Struts 5 are mounted on the rear corners 8 of the tabletop frame 2 by engaging tongues 6 projecting from each strut into corresponding apertures 7 provided in both the tabletop frame 2 and the inserted leg 3. The apertures 7 are preferably formed with a sloping lower edge so that the tongues 6 will tend to wedge into the apertures.

As shown in FIG. 2, all four legs 3 may be provided with apertures 7, thereby being interchangeable, to facilitate manufacture and ease of assembly. For the legs which become forward legs in the assembled display unit, the apertures 7 are hidden by the unbroken wall of the front section 11 of the tabletop frame 2.

The mounting of struts 5 on the tabletop frame 2 may be secured by insertion of a tapered plug 18 at each corner.

Preferably, a single tapered plug 18 may be used at each of the rear corners 8 to secure both the strut 5 and the leg 3 to the tabletop frame 2.

In addition, apertures 18*a* may be provided on each side of the tabletop frame for mounting store displays, such as sign holders (not shown) using tapered plug 18.

Each strut 5 is provided with a plurality of aligned slots 24, capable of receiving opposed upper and lower L-shaped projections 25*a* and 25*b* on shelving bracket 9, to mount the shelving bracket 9 on strut 5 as shown at 26.

Preferably, the aligned slots 24 will be provided on both angle surfaces of each strut so that the struts are interchangeable, thereby contributing to ease of assembly.

Upper shelf 10 is then placed on the two shelving brackets as shown in FIGS. 6 and 7.

Preferably an indentation 27 of channel section is formed between upper L-shaped projection 25*a* and the rear edge of bracket 9. As similar but narrower indentation 30 of channel section is also formed between the lower L-shaped projection 25*b* and the rear edge of bracket 9, but indentation 30 is preferably only wide enough to allow the lower L-shaped projection 25*b* to hook through one of the slotted apertures 24 on strut 5 with very little lateral allowance.

By contrast, indentation 27 formed with the upper L-shaped projection 25*a* is much wider, to allow projection 25*a* to be hooked first through one of the slotted apertures 24 with bracket 9 tilted upwardly, then allowing lateral sliding as the bracket is pivotted to the horizontal for hooking of projection 25*b* through a lower slotted aperture 24 on the same strut 5.

As shown in FIGS. 6 and 7, upper shelf 10 is preferably provided along its front and rear edges with rear flange 28 which engages in channel 27 in the bracket 9, and with the front flange 29 which hooks over the front of bracket 9, thus laterally securing the upper shelf 10 in place.

From FIG. 7, it will be observed that rear flange fits relatively snugly into indentation 27, thereby serving to lock the bracket 9 on strut 5 by reacting between the bracket and strut to urge the strut resiliently out into contact with the upper L-shaped projection 25*a*. Lower L-shaped projection 25*b* cooperates by being oppositely urged against strut 5 at its lower location on the strut.

Upper shelf 10 is further provided with back wall 30 which prevents displayed merchandise from falling off the back of the display unit.

From the foregoing description it will be obvious that three-legged display tables could also be constructed according to the invention with either round or triangular tabletop surfaces and modification in the angle of the angle-section legs and receiving apertures.

I claim:

1. A table assembly comprising: a tabletop frame provided with an upper inwardly- and downwardly-directed periperal flange forming a narrow channel, a lower inwardly-directed flange having defined therein at spaced intervals at least three L-shaped apertures said upper and lower flanges being connected by a peripheral wall generally perpendicular thereto; and a plurality of legs of angle-section, each leg being upwardly inserted through one of said L-shaped apertures and snugly engaged in the channel of the upper flange.

2. A table assembly, according to claim 1, wherein the tabletop frame is of rectangular four corner configuration with an L-shaped aperture formed at each corner thereof.

3. A table assembly, according to claim 2, further comprising:

two struts of angle-section mounted on two adjacent corners of the tabletop frame; and an upper shelf mounted between said two struts.

4. A table assembly, according to claim 3, wherein each strut is provided with at least one pair of inwardly-directed tongues formed on each surface of the angle-section, each tongue being received in a correspnding aperture formed in the tabletop frame, whereby to mount the struts on the tabletop frame.

5. A table assembly, according to claim 4, wherein each tongue is received in corresponding apertures formed through the tabletop frame and through each leg of angled configuration.

6. A table assembly, according to claim 4 or 5, wherein each of the corresponding apertures is formed with a lower sloping edge, whereby the tongues may be wedged in said apertures.

7. A table, according to claim 6, wherein each leg is provided, at its foot, with an inwardly- and upwardly-directed flange, the table further comprising a base frame having a downwardly-directed peripheral flange engaged with the inwardly- and upwardly-directed flanges of the legs.

8. A table assembly, according to claim 3, further comprising a pair of mounting brackets, each bracket being provided with outwardly opposed upper and lower L-shaped projections received in aligned apertures defined in each strut, whereby to mount the upper shelf.

9. A table assembly, according to claim 8, wherein the upper and lower L-shaped projections extend from the rear of each bracket, forming channels therewith, and wherein the channel formed by the upper L-shaped projection is wider than the channel formed by the lower L-shaped projection.

10. A table assembly, according to claim 9, wherein the upper shelf is provided with downwardly-directed flanges on opposed front and rear edges, the flange on the rear edge being inserted in the channel formed by the upper L-shaped projection of each bracket, and the flange on the front edge extending over the front edge of each brackets, whereby to laterally secure the upper shelf on the brackets.

11. A table assembly, according to claim 10, wherein the flange on the rear edge of the shelf reacts between each bracket and strut to urge the strut resiliently outwardly into contact with the upper projection of the bracket.

12. A table assembly according to claim 1, further comprising a base frame having a downwardly-directed peripheral flange, and wherein each leg is provided, at its foot, with an inwardly- and upwardly-directed flange for receivably engaging said flange of the base frame.

13. A table assembly, according to claim 12 wherein the base frame is provided with outer sides for urging the legs resiliently outwardly.

14. A table assembly, according to claim 12, further comprising a plurality of leaves received in side-to-side abutment on the lower flange of the tabletop frame, whereby to form a table surface.

15. A table assembly, according to claim 14, wherein the lower flange is provided with an upwardly-projecting lip and wherein each of the leaves is provided with a downwardly-directed, peripheral flange having defined therein toward opposite ends a pair of grooves for receiving the lip of the lower flange.

16. A table assembly, according to claim 1, 12, or 3, further comprising a plurality of tapered plugs, each tapered plug being inserted through complementary apertures formed in adjacent surfaces, whereby to maintain the assembly in alignment against vertical displacement.

17. A table comprising:

a tabletop frame of four corner configuration, an inwardly- and downwardly-directed peripheral flange forming a narrow channel, a lower inwardly-directed flange having defined therein at each corner an L-shaped aperture said upper and lower flanges being connected by a peripheral wall generally perpendicular thereto; and four legs of angle-section, each leg being upwardly inserted through one of the L-shaped apertures and snugly engaged in the channel of the upper frame.

18. A table, according to claim 17, wherein the lower flange is provided with an upwardly-projecting lip, the table further comprising a plurality of leaves placed on the lower flange in side-by-side abutment to form a table surface, each of the leaves being provided with a downwardly-directed peripheral flange having defined therein toward opposite ends a pair of grooves in which the lip of the lower flange is received.

* * * * *